United States Patent [19]

Zublin

[11] 4,441,557

[45] Apr. 10, 1984

[54] METHOD AND DEVICE FOR HYDRAULIC JET WELL CLEANING

[75] Inventor: Casper W. Zublin, Bakersfield, Calif.

[73] Assignee: Downhole Services, Inc., Bakersfield, Calif.

[21] Appl. No.: 308,582

[22] Filed: Oct. 5, 1981

Related U.S. Application Data

[63] Continuation-in-part of Ser. No. 195,303, Oct. 7, 1980, Pat. No. 4,349,073.

[51] Int. Cl.[3] ..... B08B 3/02; B08B 9/00; E21B 37/00

[52] U.S. Cl. ..... 166/312; 134/167 C; 166/73; 166/223; 239/550; 239/600

[58] Field of Search ..... 166/312, 73, 311, 223, 166/222, 379, 67, 250; 134/167 C, 168 C, 172, 198; 175/422; 299/16, 17; 239/550, 600

[56] References Cited

U.S. PATENT DOCUMENTS

| | | | |
|---|---|---|---|
| 1,279,333 | 9/1918 | Green | 166/222 |
| 2,186,309 | 1/1940 | Travis | 166/223 X |
| 2,228,640 | 1/1941 | O'Neill | 166/223 |
| 2,329,157 | 9/1943 | Frack | 166/222 |
| 3,310,113 | 3/1967 | Maness | 166/222 X |
| 3,720,264 | 3/1973 | Hutchison | 166/311 |
| 4,197,910 | 4/1980 | Hutchison | 166/223 |

OTHER PUBLICATIONS

*DownHole Services, Inc.,* Brochure, "Hydraulic Perforation Cleaning (HPC) Service", 6-79, pp. 1-3; 5-79, pp. 9 and 9.1.

*Primary Examiner*—Stephen J. Novosad

*Attorney, Agent, or Firm*—Knobbe, Martens, Olson and Bear

[57] ABSTRACT

A method for cleaning well liners employing a jet carrier assembly having a plurality of jet nozzles spaced along its length each of said nozzles expelling a stream of fluid against the liner. The jet carrier is rotated at a specified rotational speed and moved at a maximum vertical speed which will produce streams of fluid having the energy needed to remove the foreign matter from any size liner with any sized slots or perforations and which will clean each point on the liner at least once.

18 Claims, 7 Drawing Figures

Fig. 1
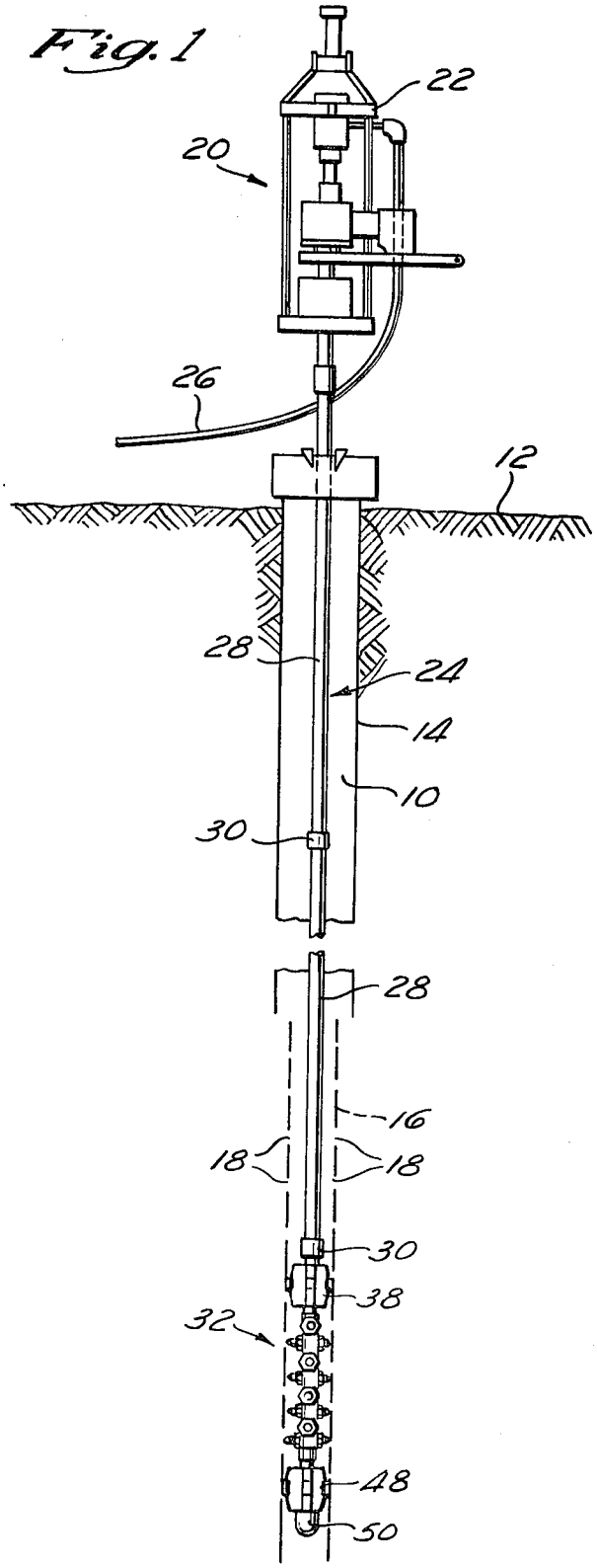
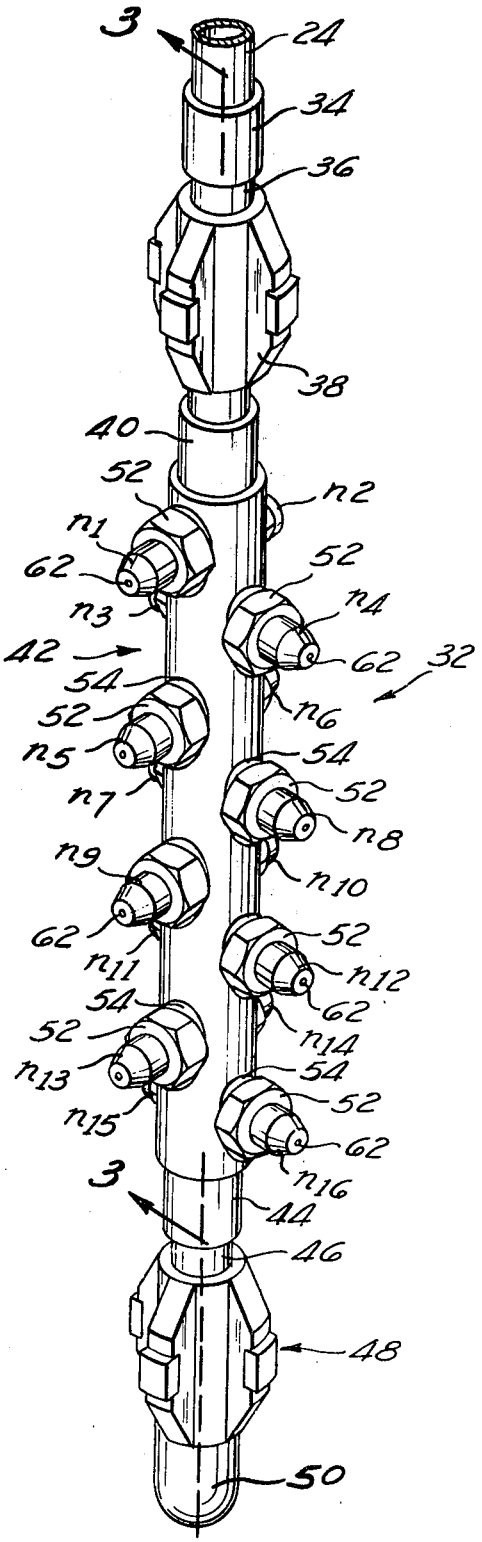
Fig. 2

METHOD AND DEVICE FOR HYDRAULIC JET WELL CLEANING

CROSS REFERENCE TO RELATED APPLICATIONS

This application is a continuation-in-part of copending application Ser. No. 195,303, filed Oct. 7, 1980 for "Hydraulic Jet Well Cleaning" now U.S. Pat. No. 4,349,073.

BACKGROUND OF THE INVENTION

The invention is specifically directed to a method for cleaning perforated, slotted and wire-wrapped well liners which become plugged with foreign material by means of devices using high velocity liquid jets. However, it will be understood that in certain instances the inventive method can be applied to cleaning pipes in general and as used herein the term "pipe" shall include well liners.

In the well producing art, it is customeray to complete wells, such as water, oil, gas, injection, geothermal, source, and the like, by inserting a metallic well liner adjacent a fluid-producing formation. Openings in the well liner provide passage-ways for flow of fluids, such as oil or water and other formation fluids and material from the formation into the well for removal to the surface. However, the openings, which, for example, may be slots preformed on the surface or perforations opened in the well, will often become plugged with foreign material, such as products of corrosion, sediment deposits and other inorganic or hydrocarbon complexes. The amount of energy which is needed to remove the different types of foreign matter varies depending upon the material. This energy can be predetermined for each and every case encountered in the field.

Since removal and replacement of the liner is costly, various methods have been developed to clean plugged openings including the use of jetted streams of liquid. The use of jets was first introduced in 1938 to directionally deliver acid to dissolve carbonate deposits. Relatively low velocities were used to deliver the fluid. However, this delivery method did improve the results of acidizing. In about 1958 the development of tungsten carbide jets permitted including abrasive material in a liquid which improved the ability of a fluid jet to do useful work. The major use of abrasive jetting has been to cut notches in formations and to cut and perforate casing to assist in the initiation of hydraulically fracturing a formation. The abrasive jetting method requires a large diameter jet orifice. This large opening required an unreasonably large hydraulic power source in order to do effective work. The use of abrasives in the jet stream permitted effective work to be done with available hydraulic pumping equipment normally used for cementing oil wells. However, the inclusion of abrasive material in a jet stream was found to be an ineffective perforation cleaning method in that it enlarged the perforation which destroyed the perforation's sand screening capability.

More recently, Chevron Research Company disclosed a method and apparatus for directionally applying high pressure jets of fluid to well liners in a number of U.S. patents. These patents were U.S. Pat. Nos. 3,720,264, 3,811,499, 3,829,134, 3,850,241 and 4,088,191, which are herein incorporated by reference.

The assignee of the subject application is a licensee of the Chevron system and developed a cleaning operation and device pursuant to the Chevron disclosures. This system employed a jet carrier of about 6 feet in length having 8 jet nozzles widely spaced along its length. The nozzles were threadably mounted on extensions which were in turn welded to the jet carrier. A fixed tri-blade pilot bit was affixed to the lower end of the jet carrier. The jet carrier was attached to a tubing string that could be reciprocated and rotated within the well bore. As the carrier was moved and rotated adjacent the liner, the nozzles directed jet streams which contacted and cleaned the liner.

This design, although an improvement over prior designs, developed a number of problems. No relationship between the vertical and rotational speeds was known which would ensure efficient and complete liner coverage by the fluid streams. Thus, if the rotational speed was held constant and the vertical speed decreased, the streams would cover the liner a multiplicity of times. If vertical speed were increased the streams would miss areas of the target. Conversely, if vertical speed were held constant and rotational speed increased, complete coverage was achieved but with insufficient energy to remove the material. If rotational speed was decreased, gaps would occur in the liner area covered by the streams.

In an attempt to solve these problems, Applicant developed its own jet carrier assembly fully described in co-pending application Ser. No. 195,303 filed Oct. 7, 1980, now U.S. Pat. No. 4,349,073 which is herein incorporated by reference.

This assembly has between about 8 and 16 nozzles spaced along its length. An equation is used to determine the jet stream track pattern against the liner for a jet tool having a given nozzle number and spacing and which is rotated and moved vertically at selected speeds. The spacing between the tracks is then calculated from this track pattern. Comparing this spacing with the known width of the jet streams determines the amount of coverage the streams provide on the liner. Using this equation, a set of rotational and vertical speeds of a constant ratio were determined which would provide jet streams having theoretical double coverage over all points on the liner when using 16 nozzles.

This design and method allows the use of greater vertical and slower rotational speeds without producing gaps in the cleaning coverage. Moreover, the decreased time to cover a given interval vertically by the virtue of increasing the vertical speed, reduces the amount of overall time necessary to do a given job, while at the same time covering all points on the liner with jet streams at least once. The new design which offered 13 different standard tool body sizes kept the nozzle within a more effective range of the target, permitting delivery of the fluid uniformly against the liner slots and perforations with an average of two to five times the energy of the Chevron system.

Although this design was a major advance in the art, it did not take into account a number of field factors. First, the design did not attempt to relate the rotational and vertical speeds to the diameter of the liner. This is important because for given values of rotational and vertical speeds, the tangential velocity of the fluid streams increases with increasing liner diameter. As the tangential velocity increases, the cleaning energy of the fluid streams decreases. With large liners, the cleaning energy can become insufficient to remove foreign matter, if corrective steps are not taken, even though the streams are striking each point on the liner twice. Thus, the prior systems did not relate the energy needed to clean the liner to the total energy actually being produced by the fluid streams. This total energy is dependent upon, not only the particular values of rotational and vertical speeds selected, but also the decrease in power of the streams as they travel between the nozzle and the liner. This power drop is in turn dependent upon the distance between the nozzle and the liner, i.e., the stand-off distance.

Thus, although the prior system insured theoretical complete coverage of the liner it did not insure that the particular rotational and vertical speeds would produce the required energy to clean foreign matter from a liner of a given size. Nor did the design take into account the energy lost by the streams between the nozzles and the liner.

As a result, a strong need continues to exist for a method of cleaning well liners which can consistently and accurately produce a given energy at the liner to clean the particular foreign material present in a controllable, economical field operation.

SUMMARY OF THE INVENTION

The inventive method is a quantum step forward in the science of well liner perforation and slot cleaning. The method employs a jet carrier having nozzles spaced along its length, each nozzle expelling a stream of fluid under pressure against the liner. The carrier is attached to a pipe string which can be moved rotationally and reciprocated within the well bore.

As the nozzles are moved vertically and rotated, the streams produce fluid tracks which form a spiral configuration. The ratio of vertical and rotational speeds controls the gaps which occur between the tracks. The width of each stream on the liner is empirically determined and then the particular ratio of rotational and vertical speed is selected to produce theoretical double coverage over the liner when using the fluid streams of 16 jets.

The next step in the process is to determine the energy needed to clean the liner and relate this energy to the factors which the operator can control in the field. For the first time, this method allows the field operator to select the rotational and vertical speeds and stand-off distance which will produce jet streams having the energy needed to clean the particular liner in the field.

After determining the energy needed to clean the liner, the power drop between the nozzle and the liner is calculated as a dependency of the stand-off distance. Knowing the power drop, one can determine the total energy of the streams at the nozzle needed to produce the required cleaning energy at the liner. The precise rotational speed and maximum vertical speed are then calculated which will produce this total energy for a given liner size.

The inventive method is not limited to the precise jet carrier employed in the preferred embodiment. For any carrier, the ratio of rotational and vertical speeds can be calculated to produce single or multiple stream coverage on the liner for any particular nozzle spacing and number. The rotational speed and maximum vertical speed needed to effectively, economically clean a particular liner are then selected.

The inventive method avoids the inefficiency of covering the liner with fluid three and four times over when not necessary and eliminates the possibility that some areas will not be contacted at all. Most importantly, it insures that the streams will deliver the energy needed to remove the foreign matter. This energy is achieved through two groups of parameters. One group is precisely controlled as part of the design criteria, and the other group has maximum control conditions so that there are no field operating problems when using values less than the maximum prescribed. The result is an efficient, effective, economical process which represents a significant advance in the art of jet well cleaning.

This quantum advance in the art will be clarified and discussed in the following section with reference to the following drawings in which:

FIG. 1 is an elevation view partially in section illustrating a jet carrier assembly within a well bore and attached to the high pressure rotating swivel;

FIG. 2 is a perspective view of the jet carrier assembly;

DETAILED DESCRIPTION OF THE PREFERRED EMBODIMENT

Figure 3:
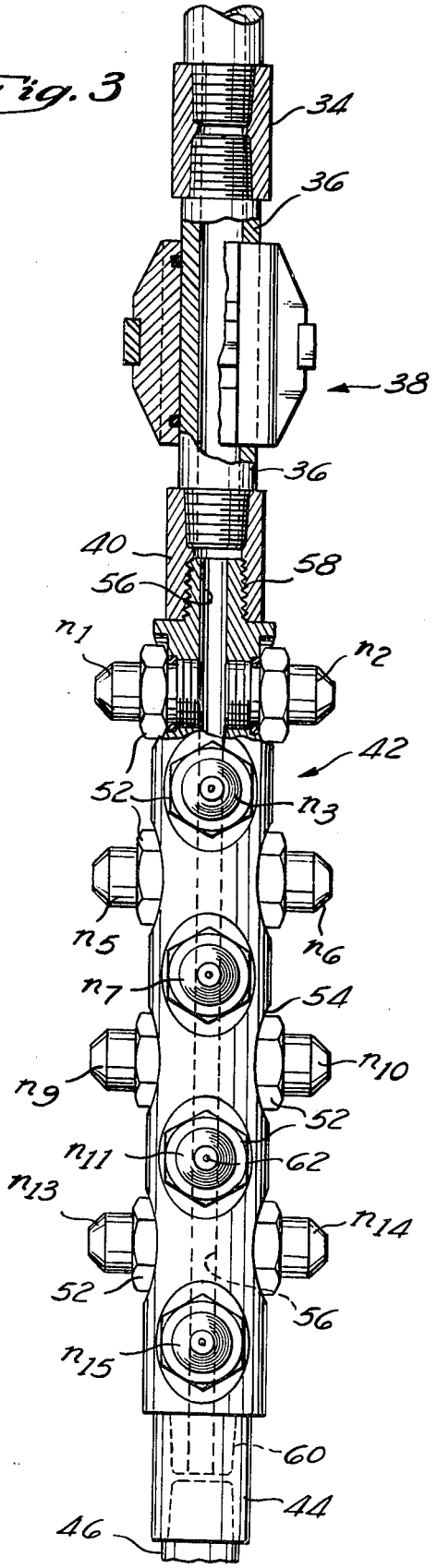
FIG. 3 is a elevation view partially in section of the portion of the jet carrier assembly above the lower centralizer.

Referring to FIG. 1, a well 10 is shown drilled into the earth's surface 12. The upper portion of the well 10 is cased with a suitable string of casing 14. A liner 16 having suitable openings 18 is hung from the casing and extends along the producing formation (not shown). The openings 18 which may be slots or perforations permit flow of formation fluids from the formation into the interior of the well 10. As the formation fluids are produced, the openings 18 in the slotted liner 16 tend to become plugged by depositions of scale, hydrocarbons, clay and sand. The plugging material in the various slots, will vary in composition and depending upon the composition, will be more or less difficult to remove. As the slot becomes plugged, production from the well declines. Once it has been determined that the openings 18 in the well liner 16 have become plugged to the extent that cleaning is required for best operation of the well, a hydraulic jet cleaning apparatus 20 is assembled to accomplish such cleaning.

The apparatus 20 is composed of a high pressure rotating swivel 22 which is in turn rotatably connected to a tubing string 24. A high pressure hose 26 provides the tubing string 24 with a source of high pressure liquid. The tubing string 24 extends downward into the well 10 by means of a series of tubing sections 28 connected by collars 30. All features thus identified of the hydraulic jet cleaning apparatus 20 form no part of the present invention. The tubing string 24 extends into a jet carrier assembly 32, adjacent the slotted liner 16.

The high pressure hose 26 supplies high pressure fluid, such as water which may be mixed with chemical additives, to the tubing string 24. The fluid travels down the tubing string 24 to the jet carrier assembly 32 from which it is jetted. The high pressure swivel 22 is utilized to permit rotation of the tubing string 24 during the jetting operation. The tubing string 24 is also reciprocated in the well 10 during such cleaning operation. To clean the openings 18 in the liner 16, the jet carrier assembly 32 is positioned adjacent the openings 18 and lifted upward while being simultaneously rotated. A cleaning operation may entail a second pass in which the jet carrier assembly 32 is moved downward while being simultaneously rotated past the openings 18 and the liner 16. More than two passes can be made if desired.

Referring to FIG. 2, an example of a jet carrier assembly 32 which can be employed in the inventive method, is shown in an enlarged perspective view. As will become clear, jet carriers having different nozzle numbers and spacing than the carrier 32 may be used. However, the carrier 32 serves as a convenient example of how a carrier is standardized and employed in the inventive method. A more detailed description of the precise structure of the carrier 32 is given in co-pending application, Ser. No. 195,303.

A portion of the tubing string 24 is connected to an upper mandrel 36. An upper centralizer 38 slidably engages the upper mandrel 36. The upper mandrel 36 is connected to a collar 40 which is in turn connected to a jet tool 42. The jet tool 42 is connected to a collar 44 which is in turn connected to a lower mandrel 46. A lower centralizer 48 slidably engages the lower mandrel 46. The lower mandrel 46 is connected to a bull plug 50. The jet tool 42 has nozzles $n_1$ through $n_{16}$ spaced along its length each having a jet orifice 62. Each of the nozzles $n_1$ through $n_{16}$ is threaded into a hexagonally shaped adapter labeled generally as 52. The adapters 52 are in turn threadably mounted within adapter seats labeled generally as 54.

Referring now to FIGS. 2 and 3, the jet tool 42 is formed of a tubular elongated member which, in the preferred embodiment, is approximately $20\frac{3}{8}$ inches in length. The diameter of the jet tool in the preferred embodiment is 2.75 inches. This diameter may be used for well liner sizes of $5\frac{1}{2}$ inches to $9\frac{5}{8}$ inches in diameter and possibly through 15 inches or even 20–30 inches. The diameter of the jet tool may become somewhat larger as the inside diameter of the pipe increases, but not significantly so. Running through the middle of the jet tool is a fluid channel 56. Located at upper and lower ends of the jet tool 42 are threaded ends 58, 60 respectively which are of similar diameter than the body of the jet tool 42.

The nozzles $n_1$ through $n_{16}$ form 8 pairs. Thus, nozzles $n_1$ and $n_2$, form a first pair, nozzles $n_3$, $n_4$ form a second pair, nozzles $n_5$ and $n_6$ form a third pair, nozzles $n_7$, $n_8$ form a fourth pair, nozzles $n_9$, $n_{10}$ form a fifth pair, nozzles $n_{11}$, $n_{12}$ form a sixth pair, nozzles $n_{13}$, $n_{14}$ form a seventh pair and nozzles $n_{15}$, $n_{16}$ form an eight pair. The nozzles in each pair are circumferentially spaced 180 degrees from each other. For example, nozzle $n_2$ is circumferentially spaced 180 degrees from nozzle $n_1$. Adjacent pairs of nozzles are circumferentially offset 90 degrees out of phase with respect to the nozzle pair formed by $n_1$, $n_2$. The four nozzles in any adjacent two pair of nozzles are directed toward the well liner at intervals of 90 degrees. Thus, the nozzles $n_1$, $n_2$, $n_3$ and $n_4$, as a group, are spaced at 90 degree intervals.

Each pair of nozzles is axially spaced from each other. In the preferred embodiment the nozzle pair $n_3$, $n_4$, is axially spaced $2\frac{1}{8}$ inches from the nozzle pair $n_1$, $n_2$. The nozzle pair $n_3$, $n_4$, is axially spaced 2 inches from the nozzle pair $n_5$, $n_6$. The nozzle pair $n_5$, $n_6$, is axially spaced $2\frac{1}{8}$ inches from the nozzle pair $n_7$, $n_8$. The nozzle pair $n_7$, $n_8$, is axially spaced 2 inches from the nozzle pair $n_9$, $n_{10}$. The nozzle pair $n_9$, $n_{10}$ is axially spaced $2\frac{1}{8}$ inches from the nozzle pair $n_{11}$, $n_{12}$. The nozzle pair $n_{11}$, $n_{12}$ is axially spaced 2 inches from the nozzle pair $n_{13}$, $n_{14}$. The nozzle pair $n_{13}$, $n_{14}$, is axially spaced $2\frac{1}{8}$ inches from the nozzle pair $n_{15}$, $n_{16}$. Thus, each alternate axial spacing is equal with one set of alternate axial spacings equaling 2 inches and the other set of alternate axial spacings equaling $2\frac{1}{8}$ inches.

During a cleaning operation, the jet tool 42 is simultaneously rotated and lifted. The rotation and vertical movement of the jet tool 42 causes the jet streams from the nozzles $n_1$ through $n_{16}$ to traverse helical paths during the cleaning operation. Further, it was empirically determined that the jet orifices 62, which in the preferred embodiment have a diameter, $D_j$, of 0.03 inches, produce a jet stream which is approximately $\frac{1}{4}$ inch in diameter at the appropriate standoff distance.

A constant ratio between the vertical and rotational speeds was then determined in relation to the number and spacing of the nozzles to provide jet tracks of fluid streams whose center to center spacing was equal to $\frac{1}{8}$ inch, i.e., one-half the width of said fluid stream, producing double stream coverage of any given point on said liner.

This derivation of the required ratio between vertical and rotational speed to produce double stream coverage was generated with a mathematical equation. The use of this equation will now be described with respect to the jet carrier 32 having the nozzle number and spacing shown. However, it should be understood that this derivation can be performed for other jet carriers having different nozzle numbers and spacing. Assume that nozzle $n_1$ is a base point, and that the jet tool will be rotated and lifted so that the jet streams from the nozzles traverse helical paths. The following equation will provide the distance in inches of a nozzle track above the base point for a certain number of revolutions. This equation is as follows:

$$t_x=(V_{TV}/R)(f)(c_i)-(a_i)+(V/R)(f)(z) \quad (1)$$

wherein:

$t_x$ = the distance in inches of nozzle $n_x$ above the base point ($n_1$ before vertical or rotational movement) after a certain number of rotations;

$V_{TV}$ = the vertical speed in feet per minute;

R = the rotational speed in rotations per minute;

f = a conversion factor for converting feet to inches;

$c_i$ = the fraction of a rotation nozzle $n_i$ is circumferentially spaced from nozzle $n_1$;

$a_i$ = the axial spacing of nozzle $n_i$ from nozzle $n_1$;

z = the lowest positive integer which will make $t_x$ positive.

The entire set of formulas for 16 nozzles which are spaced as has been described with a rotational speed of 24 rotations per minute and a vertical speed of 4 feet per minute is as follows:

$$t_1=\text{base point}=0$$

$$t_1=(4/24)(12)=2$$

$$t_2=(4/24)(12)(0.5)=1$$

$$t_3=(4/24)(12)(0.25)-2+(4/24)(12)(1)=0.5$$

$t_4=(4/24)(12)(0.75)-2+(4/24)(12)(1)=1.5$ $t_5=(4/24)(12)-4.125+(4/24)(12)(2)=1.875$ $t_6=(4/24)(12)(0.5)-4.125+(4/24)(12)(2)=0.875$ $t_7=(4/24)(12)(0.25)-6.125+(4/24)(12)(3)=0.375$ $t_8=(4/24)(12)(0.75)-6.125+(4/24)(12)(3)=1.375$ $t_9=(4/24)(12)-8.25+(4/24)(12)(4)=1.75$ $t_{10}=(4/24)(12)(0.5)-8.25+(4/24)(12)(4)=0.75$ $t_{11}=(4/24)(12)(0.25)-10.25+(4/24)(12)(5)=0.25$ $t_{12}=(4/24)(12)(0.75)-10.25+(4/24)(12)(5)=1.25$ $t_{13}=(4/24)(12)-12.375+(4/24)(12)(6)=1.625$ $t_{14}=(4/24)(12)(5)-12.375+(4/24)(12)(6)=0.625$ $t_{15}=(4/24)(12)(0.25)-14.375+(4/24)(12)(7)=0.125$ $t_{16}=(4/24)(12)(0.75)-14.375+(4/24)(12)(7)=1.125$

Taking some specific examples will clarify the use of equation (1). For example $t_1$ provides that nozzle $n_1$ after one rotation will be at a locus 2 inches directly above its original point, the base point. Since nozzle $n_2$ is circumferentially spaced one-half a rotation from nozzle $n_1$, it will be directly above the base point in one-half a rotation. Thus, for $t_2$, $V_{TV}/R$ is multiplied by 0.5 which gives a value of 1 inch. This means that the vertical distance which nozzle $n_2$ travels at the first time it is directly above the base point is 1 inch. Taking one more example, nozzle $n_3$ is circumferentially spaced from nozzle $n_1$, i.e., $c_3$, one-quarter of a rotation. However, after one-quarter of a rotation, nozzle $n_3$ will be directly below the base point because $n_3$ is axially spaced from nozzle $n_1$, i.e., $a_3$, a distance of 2 inches. Thus, after one-quarter of a rotation $n_3$ will be 1.5 inches below the base point. The factor $(V_{TV}/R)$ (12) (z) is therefore added to this value until $t_3$ becomes positive. When this occurs, nozzle $n_3$ will have traveled enough rotations to be above the base point. In order to make $t_3$ positive, the factor z must equal one. The value of $t_3$ is thus calculated to be 0.5. This means that after one and a quarter rotations, nozzle $n_3$ will, for the first time, be directly above the base point. These calculations are then made for each nozzle.

The following are the calculated values of $t_x$ from largest in magnitude to smallest in magnitude. This represents a plot of the jet tracks against the liner frozen in time when they are directly above the base point. Although the locus of points described by the jet tracks during the cleaning operation are helixes, these helixes are mutually parallel for each nozzle. Thus, the following plot of jet track positions would be true at any given point along the liner. Calculating the differential between each adjacent value of $t_x$ determines the spacing of the jet tracks. Continuing with the example when R=24 and $V_{TV}=4$, the track pattern and spacing is as follows:

| Plotted Track Pattern | |
|---|---|
| $t_x$ | Track Spacing In Inches |
| $t_1$ = 2 | .125 |

-continued

| Plotted Track Pattern | |
|---|---|
| $t_x$ | Track Spacing In Inches |
| $t_5$ = 1.875 | .125 |
| $t_9$ = 1.75 | .125 |
| $t_{13}$ = 1.625 | .125 |
| $t_4$ = 1.5 | .125 |
| $t_8$ = 1.375 | .125 |
| $t_{12}$ = 1.25 | .125 |
| $t_{16}$ = 1.125 | .125 |
| $t_2$ = 1 | .125 |
| $t_6$ = .875 | .125 |
| $t_{10}$ = .75 | .125 |
| $t_{14}$ = .625 | .125 |
| $t_3$ = .5 | .125 |
| $t_7$ = .375 | .125 |
| $t_{15}$ = .125 | .125 |
| $t_1$ = 0 | |

The track spacing between adjacent nozzles is a constant ⅛ inch. Since the thickness of the jet stream at the liner expelled from the nozzles has been determined to be ¼ inch, this combination of nozzle number, nozzle spacing and vertical and rotational speeds will provide jets which cover each point on the liner twice.

It will now be understood by those in the art that equation (1) may be used to determine the constant ratio between $V_{TV}$ and R to provide single and/or multiple jet track coverage for any given jet carrier having a particular nozzle number and spacing. In this way, every jet carrier may be standardized i.e., the ratio of $V_{TV}$ and R can be determined which will provide single and/or multiple stream coverage.

In the preferred embodiment, the optimum jet tract condition has been defined as double coverage. This is true because greater than double coverage is a waste of resources not required for proper cleaning. Clearly, less than single coverage does not provide adequate cleaning. Empirically, it was determined that double coverage per pass produces an effective yet efficient process. Moreover, for every carrier, a parameter N can be determined by taking into account the jet spacing, rotational and vertical speeds and the center to center distance on the target of the jets at given combinations of rotational and vertical speeds. In the preferred embodiment, N is defined as the number of jet tracks per inch multiplied by a factor of 2. The factor of 2 is included because the streams strike each point on the liner twice. The importance of this N value will become apparent in the succeeding derivation of equation (7).

Theoretically, any number of nozzles could be employed on a jet carrier. However, it has been found that other factors such as tool size, pipe size and optimum economic horsepower cause the acceptable range of nozzles in the preferred embodiment to be between 8–16 nozzles. Therefore, the limits of the N value in the preferred embodiment are from about 8 to 16.

An important advantage of the design is that certain jets can be eliminated from the configuration while still retaining a jet tool which hits every point on the liner at least once. Because of volumetric limitations of the pump at a given pressure, the numbers of jets can be decreased when either the depth of the well increases or the amount of liner to be cleaned increases. As more tubing is put in the hole, the opportunity for leaks at the tubing connection increases. Thus, as the depth of the well increases, the opportunity for leaks increases. Secondly, the orifice of the jet nozzles themselves tends to enlarge somewhat with use. Thus, as cleaning time duration increases, the jet nozzles enlarge. This causes a reduction in the differential pressure across the jet if the pump capacity is not sufficient to increase the volume and consequently add more horsepower to the system. To counteract this problem the number of jets can be decreased without losing at least single coverage. In practice the selected number of jets is that which will allow about a 30% excess capacity at the pump so that as the jets wear, the pump speed (volume) can be increased up to the maximum available to maintain the pressure differential across the jet over an economic interval of time.

Once it has been determined that, for example, only 14 nozzles should be used, the plotted track pattern as determined above should be consulted. The nozzles are always removed in pairs to ensure that the jet tool remains in dynamic balance. Plugs are placed within the empty adapter seats to maintain fluid pressure at the jets. Any pair of nozzles may be removed as long as adjacent jet tracks are not disturbed, as shown by the plot given above. Thus, in the example given, if nozzle $n_1$ and nozzle $n_2$ were removed, the track spacing between nozzle $n_5$ and nozzle $n_{15}$ and between nozzle $n_{16}$ and nozzle $n_6$ would be ¼ inch. This spacing ensures that each point on the liner remains covered at least once. However, if nozzles $n_{13}$ and $n_4$ were removed, for example, the spacing between the track given by nozzle $n_9$ and nozzle $n_8$ would be ⅜ inch, which is greater than ¼ inch and a gap would occur. In the field, it is often easiest to remove the pair of nozzles which are circumferentially spaced 180° from each other, for example, nozzles $n_1$ and $n_2$ or nozzles $n_{15}$ and $n_{16}$. These nozzles also are located at the end of the jet tool.

Having determined the ratio between $V_{TV}$ and R the next step is to determine the precise values of $V_{TV}$ and R which will provide the cleaning energy required to remove the particular foreign material from a given size liner. For example, the energy which is needed to remove barium sulfate from a liner is relatively high and can be determined empirically. This energy which is required to remove material will be defined the cleaning energy, C.E.

Next, the total energy, T.E., of the fluid streams at the jet which is needed to produce the required cleaning energy at the liner is calculated. The streams lose energy as they travel between the jets and the liner. This power drop is a function of the distance between the jets and liner, i.e., stand-off distance L and the diameter of the jet orifices $D_j$. In the preferred embodiment, $D_j=0.03$ inches. The relationship between the power at the target $P_L$ and the power at the jet $P_O$ is given by the following equation:

$$P_L=P_O C_M C_V^2 (D_j/L)^3 P_L<P_O \quad (2)$$

wherein:

$P_L$=Power at the target in ft-lb/sec $P_O$=Power at jet in ft-lb/sec $C_M$=5.2, a dimensionless constant $C_V$=6.4, a dimensionless constant $D_j$=Nozzle diameter in inches L=distance from the nozzle to the target in inches Equation 2 is a combined statement presented by Brown, R. W. and Loper, J. L. in their document "Theory of Formation Cutting Using the Sand Erosion Process", J. Pet. Tech., May 1961 and Forstal, W. and Gaylord, E. W. in their document "Momentum and Mass Transfer in a Submerged Water Jet", Journal of Applied Mechanics, June 1955 which are hereby incorporated by reference.

$P_O$ in equation (2) can be expressed as follows:

$$P_O=M_o V_o^2/2 \quad (2a)$$

wherein:

$M_o$=mass of expelled fluid at the jet $V_o$=velocity of expelled fluid at the jet Substituting the value of $P_O$ obtained from equation (2a) in equation (2) provides:

$$P_L=M_o V_o^2/2 C_M C_V^2 (D_j/L)^3 \quad (2b)$$

It will be understood that equation 2(b) is a generalized statement which includes the loss for velocity fall-off as well as the power loss because of increasing distance.

Substituting the values of $C_m$ and $C_v$ in equation 2 provides:

$$P_L=213 P_O (D_j/L)^3 P_L<P_O \quad (2c)$$

Equation (2c) is valid when the cleaning fluid in water whose density is from about 8.3 lb/gal to about 8.7 lb/gal and which is substantially free of suspended or entrained solids, but not necessarily dissolved solids.

Figure 4:
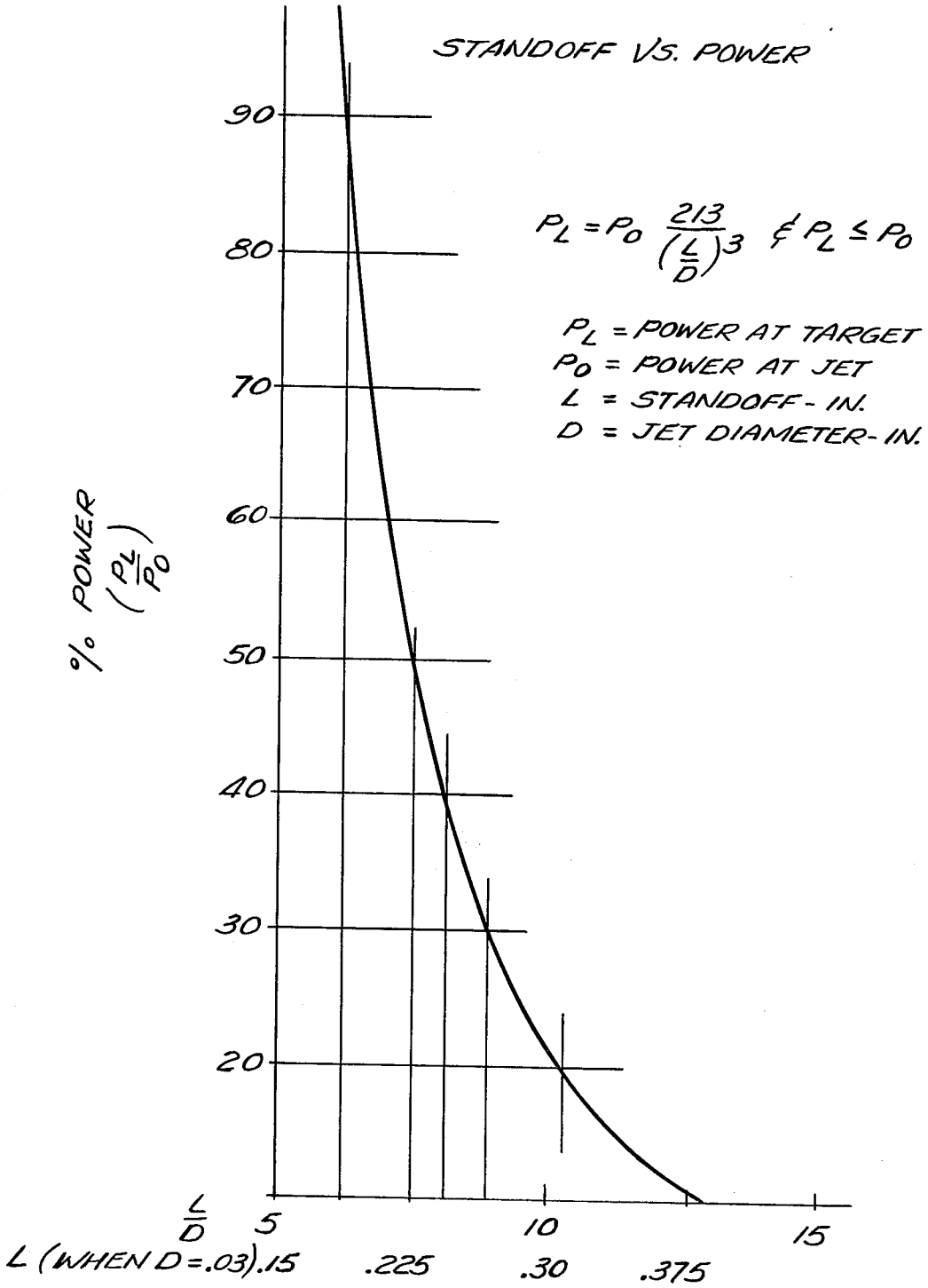
FIG. 4 is a graph showing the percent power loss of the streams between the nozzles and the liner plotted against the ratio of the stand-off distance and jet orifice diameter.

Employing equation (2c), the graph of $P_L/P_O$ expressed as a percent versus $L/D_j$ is shown in FIG. 4. This graph assumes that $P_O$ is greater than or equal to $P_L$ which empirically will always be true. The graph illustrates that if the ratio of stand-off distance to jet diameter rises above 10, the power drop becomes so great as to be impractical within normal operation limits. If the stand-off distance jet diameter ratio is slightly less than 6 then there is no power drop off. Moreover, it has been empirically determined by early researchers (Bernouli et al) that at about a ratio of 1.5 or less no jet power is developed. In the preferred embodiment, L/D averages 7.5 which provides a power drop of about 50%. Thus, if the cleaning energy required to clean the liner is 200 lb.-ft., the total energy needed at the jet is 400 lb.-ft.

In the preferred embodiment the stand-off distance L can be controlled by use of the centralizers 38, 48 and adapters 52 as fully described in co-pending Ser. No. 195,303, now U.S. Pat. No. 4,349,073.

In general, the nozzles $n_1$ through $n_{16}$, and the jet tool 42, are of a standard size. However, the adapters 52 come in a variety of sizes. As the size of the adapters 52 increases, the distance the nozzles protrude from the axial centerline of the carrier will accordingly increase.

The adapters 52 are therefore extremely important in determining the stand-off distance between the nozzles and the well liner 18.

The outer diameter of the centralizers 38, 48 also plays an important role in maintaining the required stand-off distance. Thus, the centralizers 38, 48 are provided in various sizes depending upon the size of the liner. For any given liner, there is a centralizer size available which will provide the required stand-off distance.

The centralizers 38, 48 are also sized to prevent the jet nozzles from contacting the metal walls of the liner, thereby eliminating closing by peening of the jet orifice. Moreover, the pair of centralizers ensures the concentric rotation of the jet carrier 32.

In order to be able to produce the required total energy, T.E., in the field, an equation is needed which relates this energy to the rotational and vertical speeds of the carrier and other parameters which can be field controlled. The derivation of such equation begins with the following expression provided in the literature:

$$Q=69D_j^2(P/e)^{\frac{1}{2}} \quad (3)$$

Wherein:

Q=Flow rate in gallons per minute $D_j$=Diameter of the jet orifice in inches

P=Pressure drop across jet in psi e=Fluid Density in lb./gal., limited to Newtonian fluids, whose velocity approximates that of water, i.e., 8.3 to 8.7 lb./gal.

Equation (3) was presented in an article written by Halliburton Company engineers entitled, "Investigation of Abrasive/Laden/Fluid Method for Perforation and Fracture Initiation" in May 1961 in the Journal of Petroleum Technology which is herein incorporated by reference. This expression has since been adopted by Chevron Oil Research Company.

Next, the velocity of the fluid $V_f$ expressed in ft./sec. is defined as follows:

$$V_f=0.408Q/D_j^2 \quad (4a)$$

Substituting the value of Q obtained from equation (3) in equation (4a) provides:

$$V_f=28[P/e]^{\frac{1}{2}} \quad (4b)$$

Another parameter, the impact, I, of the fluid streams defined as kinetic energy expressed in lb./ft. per second is as follows:

$$I=\tfrac{1}{2}M(V_f)^2/\text{sec.}=\tfrac{1}{2}(W/g)(V_f)^2 \quad (5a)$$

wherein:

M=Mass of the fluid,

W=Weight of the fluid used in one second, g=Gravity, i.e., 32 ft./sec.$^2$

W, defined as the weight of the fluid in lbs./sec., is as follows:

$$W=Qe/60 \quad (5b)$$

Substituting the value of W from equation (5b), the value of Q from equation (3) and the value of $V_f$ from equation (4b) into expression (5a) provides:

$$I=14.1(D_j)^2P^{3/2}/e^{\frac{1}{2}} \quad (5c)$$

The next parameter to determine is the tangential velocity of the jet at the target $V_T$ expressed in in./sec. $V_T$ can be expressed in terms of the horizontal component $V_{TH}$ and its vertical component $V_{TV}$ which are mutally perpendicular. Applying vectorial addition provides the following expression:

$$V_T=[(V_{TH})^2+(V_{TV})^2]^{\frac{1}{2}} \quad (6a)$$

It should be clear that $V_{TV}$ is the vertical travel rate of the carrier discussed at length throughout expressed in in./sec.

The horizontal component $V_{TH}$ can be expressed as a function of the rotational speed R and the diameter of the liner, D, as follows:

$$V_{TH}=(R/60)(\pi D) \quad (6b)$$

wherein:

R=the jet carrier rotational speed in rpm, $\pi$=3.14,

D=Inside diameter of the liner in inches.

As described in detail above, with reference to equation (1), the vertical component $V_{TV}$ can be expressed in terms of R as follows:

$$V_{TV}=cR \quad (6c)$$

wherein:

c is a constant

In the preferred embodiment c=1/30 because $V_{TV}$/R/6 ft./min.=R/30 in./sec.

Substituting both the expression for $V_{TH}$ given in equation (6b) and the expression for $V_{TV}$ given in equation (6c) into equation (6a) provides:

$$V_T=[(RD/19.09)^2+(cR)^2]^{\frac{1}{2}} \quad (6d)$$

The total energy, T.E., of the streams at the jets is directly proportional to the impact I, the area, A, of the slot or perforation on the liner, and the value N i.e., twice the number of jet tracks per inch. The total energy is inversely proportional to the tangential velocity $V_T$. Making the proper substitution from equations (5c) and (6d) provides:

$$TE = INA/V_T = \frac{14.1\,(D_j)^2P^{3/2}NA}{e^{\frac{1}{2}}[(RD/19.09)^2 + (cR)^2]^{\frac{1}{2}}} \quad (7)$$

For a slot, A=the length of the slot times its width. For a perforation, $A=\pi D_P^2/4$ wherein $D_P$ is the diameter of the perforation.

Using equation (7), R can be determined since all of the other variables are known or can be found. For example, in the preferred embodiment:

$D_j$=0.03 inches

P=7500 psi

N=8–16 e=8.3 lb./gal.

For the particular liner to be cleaned, the total energy, liner diameter and slot or perforation area are then calculated. Once R is determined, $V_{TV}$ is calculated using equation (6c).

In the field, R is easy to control and V is not. Therefore, the value of R is that which is employed in the field. Ideally the operator would like to employ the value of V as calculated also. However, since this is difficult it should be understood that the calculated value of V used is a maximum value employed. If the value of V used is greater than that calculated incomplete liner cleaning results. However, if the value of V used is less than calculated the process may be somewhat time inefficient but the liner will be completely cleaned.

Figure 5:
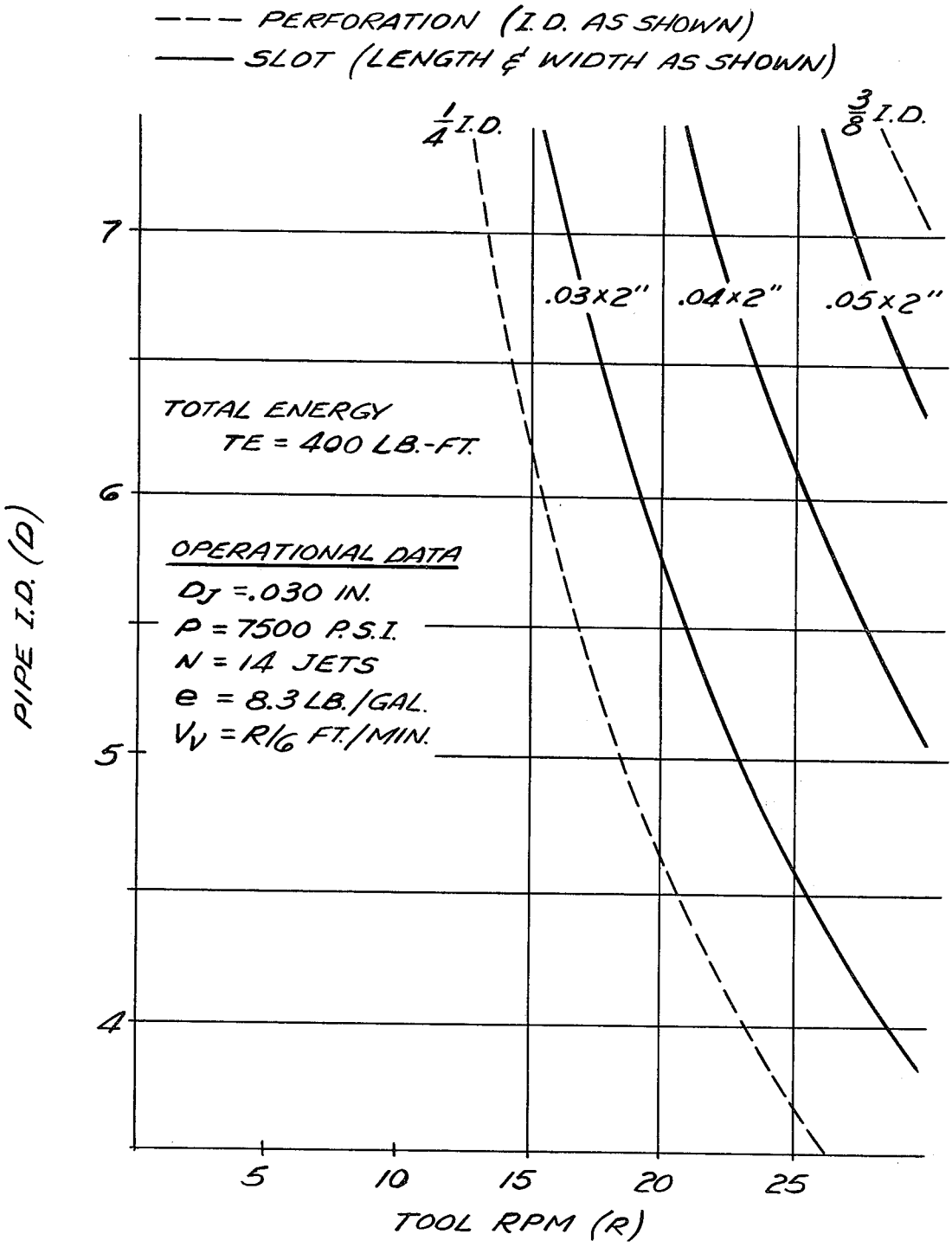
FIG. 5 is a graph showing the liner diameter plotted against the rotational speed of the jet carrier for a total energy of 400 lb.-ft. and a given set of field parameters.
Figure 6:
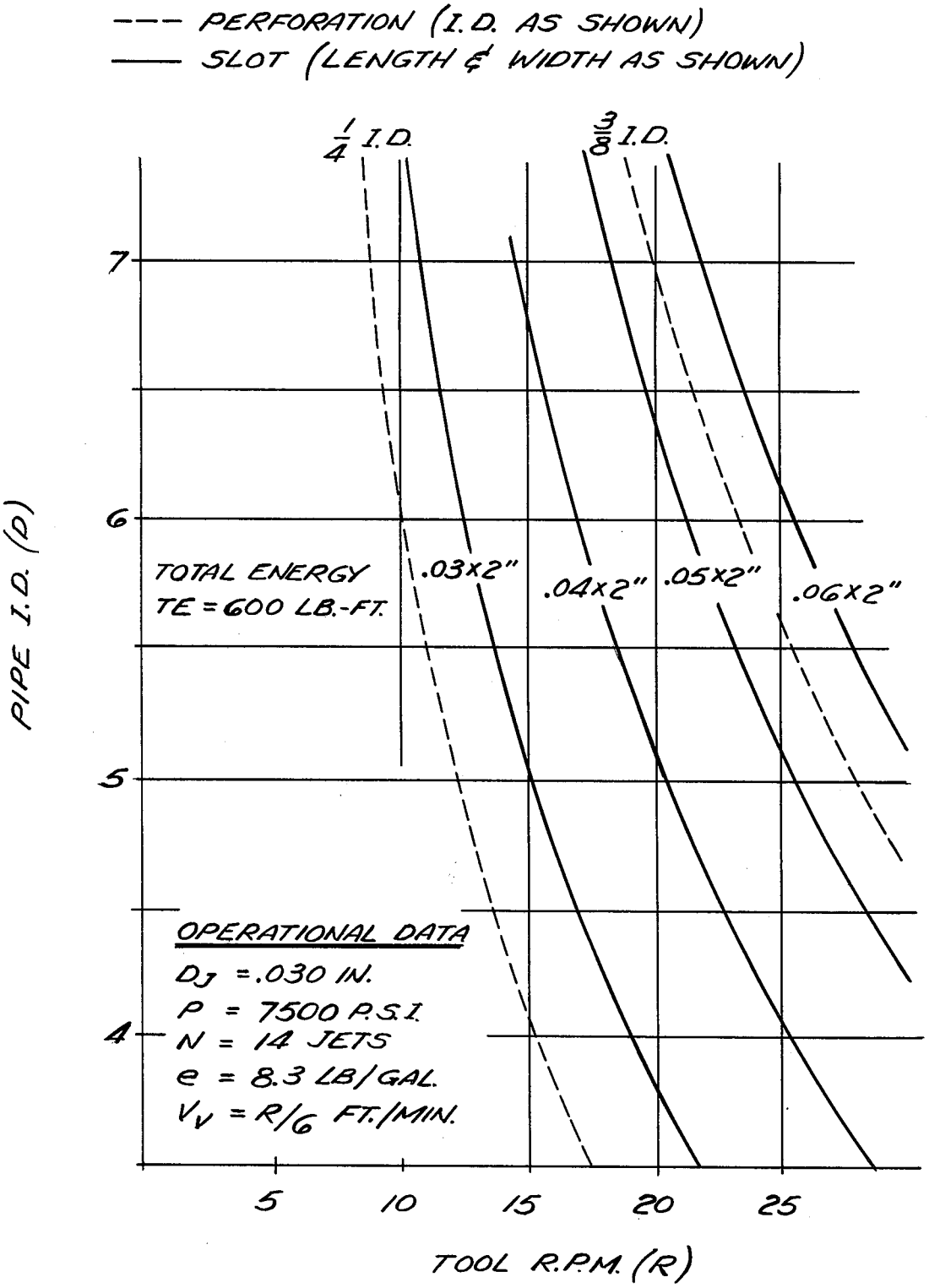
FIG. 6 is a graph similar to FIG. 5 except for a total energy of 600 lb.-ft.
Figure 7:
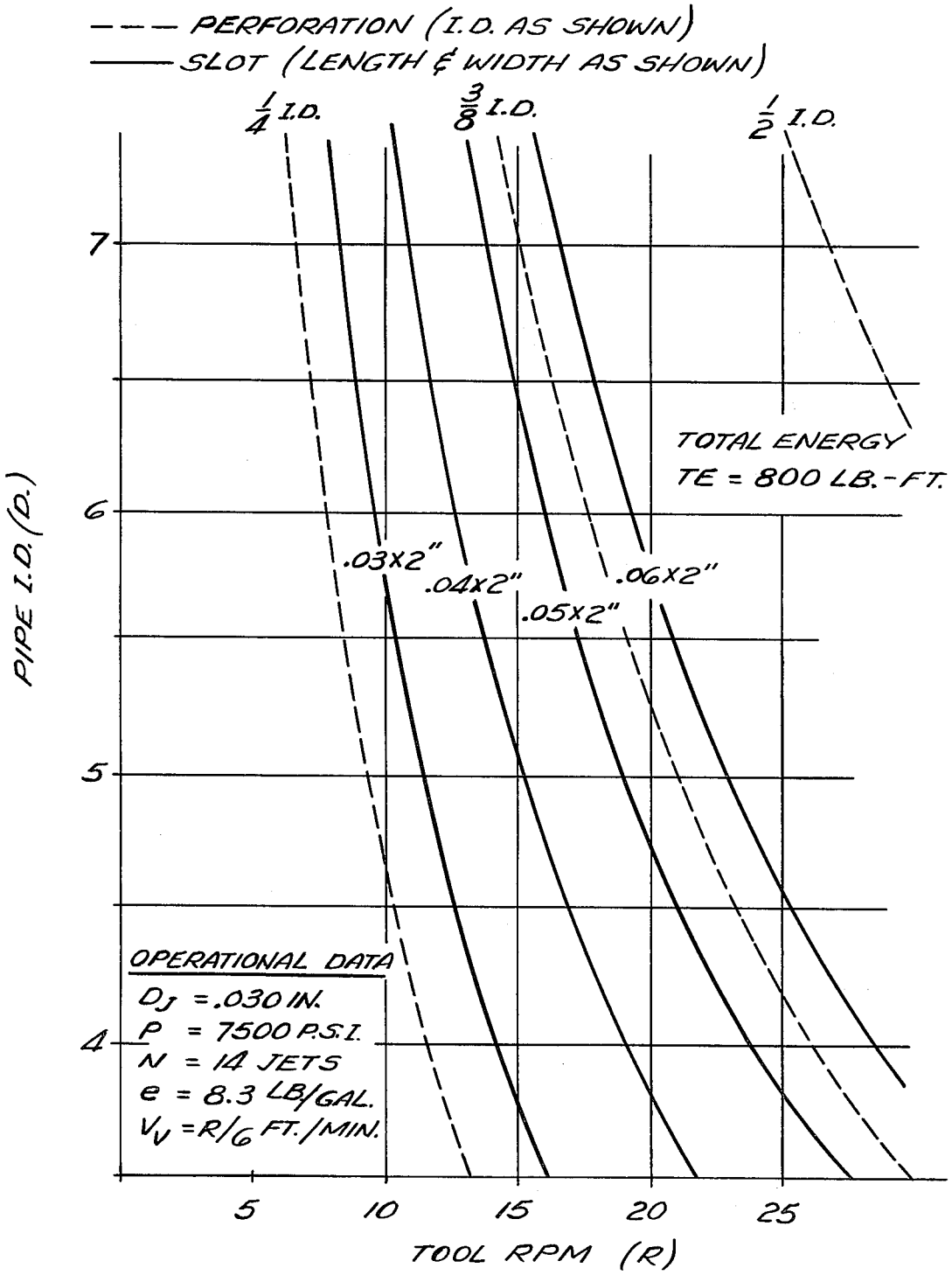
FIG. 7 is a graph similar to FIGS. 5 and 6 except for a total energy of 800 lb.-ft.

FIGS. 5, 6 and 7 are graphs which relate the size of the liner to the rotational speed in various exemplary field conditions. In particular, FIGS. 5, 6 and 7 include data based on total energies of 400, 600 and 800 lb.-ft. respectively.

Alternatively, the total energyy TE may be expressed as a function of the surface area of the liner to be covered. Thus, the total energy per square inch of liner TE' is expressed as follows:

$$TE' = \frac{14.1\,(D_j)^2 P^{3/2} N}{e^{\frac{1}{2}}[(RD/19.09)^2 + (cR)^2]^{\frac{1}{2}}} \quad (8)$$

It should be understood that if equation (8) is employed, the value of TE' is determined from taking a given percentage of the cleaning energy per unit area, CE', needed to remove the particular foreign material. This percentage is calculated using equation (2) in the same manner as has been described. It should also be understood that the proof values of CE or CE' are empirically determined.

The inventive method for the first time allows the operator to provide the required energy which is needed to clean a liner of a particular size having a particular foreign material to remove. Using this method the operator can determine the precise rotational and vertical speeds which are required to produce this total energy. Moreover, this combination of rotational and vertical speeds will produce jet streams which strike every point on the liner at least once and theoretically not more than twice so that the operation is not only effective but extremely efficient.

What is claimed:

1. A device for washing pipes comprising:

an elongate member having a plurality of jet nozzles mounted thereon, at least some of said jet nozzles being spaced along the length of said member, said nozzles being spaced such that when said member is moved at a preselected constant speed along the length of a preselected pipe to be cleaned and rotated at a preselected constant rotational speed jet tracks of fluid streams are provided whose center to center spacing is in the range of equal to or one-half the width of said fluid streams at the inner surface of the pipe producing stream coverage of all points on the pipe to be cleaned of at least once but not more than twice.

2. The device of claim 1 wherein the ratio of the preselected lengthwise speed, in feet-per-minute, to the preselected rotational speed, in rotations-per-minute, is one to six.

3. The device of claim 1 including means for rotating and reciprocating said elongate member within the pipe to be cleaned, said rotating and reciprocating means being set such that said elongate member is moved along the length of the pipe at said preselected speed and rotated at said preselected rotational speed.

4. A method for washing pipes comprising:

providing an elongate member having no less than about 8 and no more than about 16 jet nozzles mounted thereon, at least some of said jet nozzles being spaced along the length of said member;

moving said elongate member lengthwise along said pipe at a selected speed;

rotating said elongate member within said pipe at a selected rotational speed;

said lengthwise and rotational speeds being chosen in relation to the member and spacing of the nozzles to provide jet tracks which cover any given point on the inner surface of said pipe at least once but not more than twice.

5. A device for washing pipes comprising:

an elongate member having jet nozzles $n_1, n_2, n_3, \ldots n_x$ wherein x is an integer no less than about 8 and no greater than about 16, said jet nozzles $n_2, n_3 \ldots n_x$ being spaced from nozzle $n_1$ a distance $d_i$, $d_i$ belonging to the set $(d_2, d_3 \ldots d_x)$ wherein $d_x$ is the distance nozzle $n_x$ is spaced from nozzle $n_1$;

the set of $d_i$'s being of a magnitude to provide jet tracks of fluid spray whose center to center spacing is in the range of equal to or one-half the width of said fluid spray producing a spray coverage of all points on a pipe to be cleaned of at least once but not more than twice when the member is moved at a selected constant speed along the length of the pipe to be cleaned and rotated at a selected constant rotational speed.

6. A device for washing pipes comprising:

an elongate tubular member having jet nozzles $n_1, n_2, n_3 \ldots n_x$ wherein x is the total number of nozzles, said jet nozzles $n_2, n_3 \ldots n_x$ being circumferentially spaced from nozzle $n_1$ a distance $c_i$ wherein $c_i$ belongs to a set $(c_2, c_3 \ldots c_x)$ $c_x$ representing the distance nozzle $n_x$ is circumferentially spaced from nozzle $n_1$, said jet nozzles being axially spaced from nozzle $n_1$ a distance $a_i$ wherein $a_i$ belongs to a set $(a_2, a_3, \ldots a_x)$ $a_x$ representing the distance nozzle $n_x$ is axially spaced from the nozzle $n_1$, the sets of $c_i$'s and $a_i$'s being of a magnitude to provide jet tracks which cover all points on a pipe to be cleaned at least once but not more than twice when the member is moved at a selected constant speed along the length of the pipe to be cleaned and rotated at a selected constant rotation speed.

7. A device for washing pipes comprising:

an elongate member having no less than about 8 and no more than about 16 jet nozzles mounted thereon, at least some of said jet nozzles being spaced along the length of said elongate member, said nozzles being spaced to provide jet tracks of fluid spray whose center to center spacing is in the range of equal to or one-half the width of said fluid spray providing a spray coverage of all points on a pipe to be cleaned of at least once but not more than twice when the member is moved at a selected constant speed along the length of the pipe to be cleaned and rotated at a selected constant rotational speed;

adaptors for receiving said jet nozzles detachably mounted on said member and variable in size to permit adjustment of the pipe to jet nozzle stand off distance; and a centralizer located proximate to each end of the member, said centralizers being sized to prevent the jets from contacting the pipe to insure concentric rotation of the member.

8. A method for selecting the number of jet nozzles to employ in cleaning a pipe comprising:

(a) providing a tool having jet nozzles $n_1, n_2, n_3 \ldots n_x$ spaced along its length;

(b) determining the depth of the pipe and the length of pipe to be cleaned;

(c) determining the number of jet nozzles required to clean said pipe based upon the determination in step (b);

(d) selectively removing nozzles from said tool to provide (1) the nozzle number determined in step (c) and (2) the nozzle spacing which will produce jet track coverage of all points on the pipe of at least once.

9. A method for washing undesirable material from pipes comprising:

providing a jet carrier having a plurality of jet nozzles mounted thereon, at least some of said jet nozzles being spaced along the length of said jet carrier;

forcing a fluid through each nozzle to produce streams of fluid which strike the pipe;

moving said carrier lengthwise along said pipe at a selected speed;

rotating said carrier within said pipe at a rotational speed;

determining the velocity of movement of one of said streams of fluid across the inner surface of the pipe which will provide sufficient energy to remove the undesirable material from the pipe; and selecting said lengthwise and rotational speeds such that they provide jet streams which cover any given point on said pipe at least once and such that the velocity of movement of each jet stream across the inner surface of the pipe is substantially equal to the velocity determined to provide sufficient energy to remove the undesirable material from the pipe.

10. A method for cleaning a pipe, said pipe having an inside diameter, D, and having foreign matter which requires a minimum energy per unit area, CE′, for removal comprising:

providing a jet carrier having a plurality of jet nozzles mounted thereon, at least some of said jet nozzles being spaced along the length of said jet carrier, each nozzle having an orifice of diameter, $D_j$;

forcing a fluid having a density, e, through each of said jet orifices with a pressure, P, across each jet to provide a stream of fluid from each nozzle having a width, W, when it strikes the pipe;

spacing said nozzles from the pipe a stand-off distance, L;

determining the ratio between the power of the fluid streams at the pipe, $P_L$, versus the power at the nozzles, $P_O$, according to the equation:

$$P_L/P_O=213/(L/D_j)^3$$

determining the total energy per unit area of the fluid at the nozzles, TE′, needed to provide the energy CE′ at the pipe according to the equation:

$$TE'=CE'/(P_L/P_O)$$

rotating said jet carrier at a rotational speed R within the pipe;

moving said jet carrier at a speed within and along the length of the pipe no greater than $V_{TV}$;

determining the ratio of R and $V_{TV}$ for the particular nozzle number and spacing and stream width which will provide fluid stream that cover each point on the pipe twice;

selecting the value of R and $V_{TV}$ which will provide fluid streams having the required energy per unit area, TE′, for cleaning the pipe according to the equation:

$$TE' = \frac{14.1\, D_j^2 P^{3/2} N}{e^{\frac{1}{2}}((RD/19.09)^2 + (V_{TV})^2)^{\frac{1}{2}}}$$

wherein: N=twice the number of jet tracks per inch.

11. The method of claim 10 wherein the number of said nozzles is no less than about 8 and no greater than about 16.

12. The method of claim 10 wherein said stand-off distance L is about 6–10 times the diameter of the jet orifice $D_j$.

13. The method of claim 10 wherein said fluid is water.

14. A method for washing material from pipes comprising:

providing a jet carrier having a plurality of jet nozzles spaced along its length;

forcing a fluid through each nozzle to produce streams of fluid which strike the pipe;

determining the amount of cleaning energy per unit area needed to remove the material from the pipe;

spacing said jet carrier from the pipe a stand-off distance;

determining the amount of fluid energy needed by the streams at the nozzles to produce said cleaning energy;

determining the ratio of jet carrier rotational speed and speed along the length of the pipe to be cleaned for the particular nozzle number and spacing which will provide streams that cover each point on the pipe at least once;

determining the particular values of rotational and lengthwise speeds in said ratio in relation to the size of the pipe which will produce said fluid energy; and rotating said carrier and moving said carrier lengthwise within the pipe at said values of rotational and lengthwise speeds.

15. A method for cleaning a well liner, said well liner having an inside diameter, D, and having openings clogged with foreign matter which requires a minimum of energy, CE, for removal, each of said openings having an area, A, comprising:

providing a jet carrier having a plurality of jet orifice of diameter, $D_j$;

forcing a fluid having a density, e, through each of said jet orifices with a pressure, P, across each jet to provide a stream of fluid from each nozzle having a width, W, when it strikes the liner;

spacing said nozzle from the liner a stand-off distance, L;

determining the ratio between the power of the fluid streams at the liner, $P_L$, versus their power at the nozzles, $P_O$, according to the equation:

$$P_L/P_O=213/(L/D_j)^3$$

determining the total energy of the fluid at the nozzles, TE, needed to provide the energy CE at the liner according to the equation:

$$TE=CE/(P_L/P_O)$$

rotating said jet carrier at a rotational speed R within the liner;

moving said jet carrier at a speed within and along the length of the liner no greater than $V_{TV}$;

determining the ratio of R and $V_{TV}$ for the particular nozzle number and spacing and stream width which will provide fluid streams that cover each point on the liner twice;

selecting the value of R and $V_{TV}$ which will provide fluid streams having the required energy TE for cleaning the pipe according to the equation:

$$TE = \frac{14.1\,(D_j)^2 P^{3/2} NA}{e^{\frac{1}{2}}((RD/19.09)^2 + (V_{TV})^2)^{\frac{1}{2}}}$$

wherein: N=twice the number of jet tracks per inch.

16. A method for washing material from pipes comprising:

providing a jet carrier having a plurality of jet nozzles mounted thereon, at least some of said jet nozzles being spaced along the length of said jet carrier;

forcing a fluid through said nozzles to produce streams of fluid which strike the pipe;

determining the amount of fluid energy needed by the streams at the point of contact with the interior of the pipe to remove said material from the pipe;

selecting a ratio of jet carrier rotational speed and speed along the length of the pipe for the particular nozzle number and spacing which will provide streams that cover each point on the pipe at least once;

selecting particular values of rotational and lengthwise speeds in said ratio which will produce a fluid energy at the inner surface of the pipe substantially equal to said fluid energy determined to be sufficient to remove said material from said pipe while at the same time maximizing the lengthwise speed of said jet carrier;

rotating said carrier within said pipe at said selected value of rotational speed; and moving said carrier lengthwise within said pipe at said selected value of lengthwise speed.

17. A device for washing pipes comprising:

an elongate member having axially spaced pairs of jet nozzles, $p_1, p_2 \ldots p_x$, along its length;

said nozzle pairs $p_1, p_2 \ldots p_x$, being axially spaced from each other a distance $d_i$, $d_i$ belonging to the set $(d_{1,2}, d_{2,3}, \ldots d_{x-1,x})$ wherein $d_{x-1,x}$, is the axial spacing between pair $p_{x-1}$ and pair $p_x$ $d_{x-1,x}$;

the set of $d_i$'s being of a magnitude to provide jet tracks which cover all points on a pipe to be cleaned at least once but not more than twice when the member is moved at a selected constant speed along the length of the pipe to be cleaned and rotated at a constant selected rotational speed and wherein each alternate $d_i$ is equal.

18. The device of claim 17 wherein x is in the range of 4 to 8 inclusive and wherein one set of alternate $d_i$'s is about 2 inches and wherein the other set of alternate $d_i$'s is about $2\frac{1}{8}$ inches.

* * * * *

UNITED STATES PATENT AND TRADEMARK OFFICE

CERTIFICATE OF CORRECTION

PATENT NO. : 4,441,557

DATED : April 10, 1984

INVENTOR(S) : Casper W. Zublin

It is certified that error appears in the above-identified patent and that said Letters Patent is hereby corrected as shown below:

Column 9, line 54, " < " should read -- ≤ --.

Column 10, line 23, "< " should read -- ≤ --.

Column 11, line 15, delete the word "velocity" and insert -- viscosity --.

Column 16, line 38, after "jet", second occurrence, insert -- nozzles spaced along its length, each nozzle having an --.

Signed and Sealed this

*Twelfth* Day of *February 1985*

[SEAL]

*Attest:*

DONALD J. QUIGG

*Attesting Officer* *Acting Commissioner of Patents and Trademarks*